US005658126A

United States Patent [19]

Werner et al.

[11] Patent Number: 5,658,126

[45] Date of Patent: Aug. 19, 1997

[54] SIDE CHANNEL COMPRESSOR

[75] Inventors: Helmut Werner, Wollbach; Peter Fischer, Bad Neustadt; Klaus Schoenwald, Bad Neustadt; Norbert Aust, Bad Neustadt, all of Germany

[73] Assignee: Siemens Aktiengesellschaft, Munich, Germany

[21] Appl. No.: 533,972

[22] Filed: Sep. 26, 1995

[30] Foreign Application Priority Data

Oct. 20, 1994 [DE] Germany ..... 44 37 589.1

[51] Int. Cl.[6] ..... F04D 05/00

[52] U.S. Cl. ..... 415/55.1; 415/55.4; 415/173.1

[58] Field of Search ..... 415/55.1, 55.4, 415/170.1, 173.1

[56] References Cited

U.S. PATENT DOCUMENTS

| | | | |
|---|---|---|---|
| 2,468,246 | 4/1949 | Thayer | 415/55.1 |
| 3,079,866 | 3/1963 | Walker | 415/173.1 |
| 4,806,073 | 2/1989 | Schonwald | 415/55.1 |
| 4,973,220 | 11/1990 | Soar et al. | 415/55.1 |

FOREIGN PATENT DOCUMENTS

| | | | |
|---|---|---|---|
| 2 244 933 | 3/1974 | Germany . | |
| 247725 | 7/1987 | Germany | 415/55.1 |
| 128993 | 7/1984 | Japan | 415/55.4 |
| 9211792 | 11/1984 | Japan | 415/55.1 |
| 724800 | 3/1980 | U.S.S.R. | 415/55.1 |
| 0 703 696 | 2/1954 | United Kingdom . | |

*Primary Examiner*—Edward K. Look
*Assistant Examiner*—Mark Sgantzos
*Attorney, Agent, or Firm*—Kenyon & Kenyon

[57] ABSTRACT

A side channel compressor with an impeller with delivery blades that has a seal to prevent leakage between the impeller and the impeller housing. A hub supporting the impeller connects it to a drive shaft. A housing surrounds the impeller, which rotates therein. A sealing device is provided between impeller and housing. The impeller is provided with a bearing ring that overhangs the hub. The overhanging portion of the bearing ring contacts a sealing ring held against a contact surface of the housing by a retaining ring. The retaining ring can be fastened to the housing by screws. The bearing ring can be provided with a corner recess to more securely engage the sealing ring.

4 Claims, 1 Drawing Sheet

SIDE CHANNEL COMPRESSOR

BACKGROUND OF THE INVENTION

The present invention relates to a side channel compressor having an impeller arranged in its housing in a manner allowing rotation. The impeller has a bearing ring with delivery blades. The bearing ring at least on one side axially overhangs a hub part that supports and joins it to a drive shaft. A compressor sealing device is provided in the area of the bearing ring sealing a gap existing between the impeller and the housing.

Such a side channel compressor is known from the German laid open print, 22 44 933. In this known compressor a band is inserted in an annular slot provided in the housing which extends towards the front side of the bearing ring. The band is placed in position in the annular slot in such a way that a gap results between the front side of the bearing ring and the end of the band protruding from the annular slot which is kept as small as possible to keep the so-called gap leakage as little as possible.

From the manufacturing point of view, it is already very costly to provide the necessary annular slot in the housing. Adjusting the band to achieve a uniform and narrow gap causes considerable difficulty. Furthermore, a wider gap remains at the joint of the band in the circumferential direction which leads to pressure loss.

SUMMARY OF THE INVENTION

The present invention provides a side channel compressor of this type in which the sealing of the gap is considerably improved and still entails lower manufacturing and assembly costs.

In accordance with the present invention, there is a radially extending sealing ring butting against the inner circumference of the axially protruding section of the bearing ring that is restrained by means of a retaining ring against a contact surface provided on the housing. By the arrangement of the sealing ring within the bearing ring protruding axially with respect to the hub part, a closed annular shape of the sealing ring is made possible. From the standpoint of production engineering, the outside diameter of the sealing ring can be fitted very precisely to the inside diameter of the bearing ring. The retaining ring is fastened advantageously by means of screws.

In an advantageous embodiment of the present invention, the sealing ring engages with a corner recess formed in the area of the respective front side of the bearing ring. Thus, a machined surface is available for the radial bearing of the sealing ring. Furthermore, an axial support of the sealing ring results in the area of its periphery when the sealing ring, because of its elasticity, is axially displaced here by the prevailing compression pressure.

DETAILED DESCRIPTION

Figure 1:
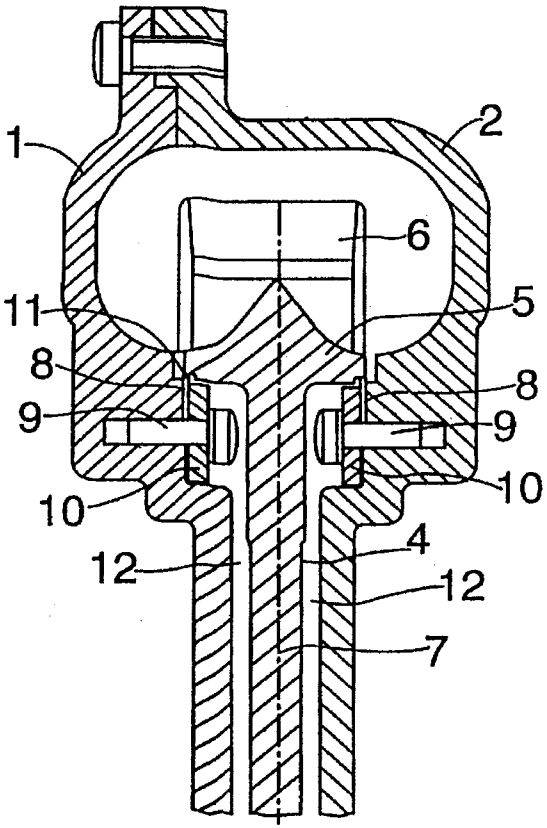
FIG. 1 shows a partial longitudinal section of a side channel compressor.

As shown in FIG. 1, the housing halves forming the housing of a side channel compressor are designated with 1 and 2. The housing halves 1 and 2 enclose an impeller 4 arranged on a drive shaft not depicted in the drawing. On its periphery the impeller 4 has a bearing ring 5 on which the delivery blades 6 of the impeller 4 are arranged. The bearing ring 5 is arranged on a hub part 7 that is mounted on the drive shaft and joined to said drive shaft in a rotatably fixed manner.

A sealing arrangement is provided on each housing half 1 and 2 in the area that is radially within the bearing ring 5 bordering on it. This consists of a plastic sealing ring 8 that is held by a retaining ring 10 fastened by means of screws 9 against a corresponding contact surface provided on the housing wall of the respective housing half 1 or 2.

Figure 2:
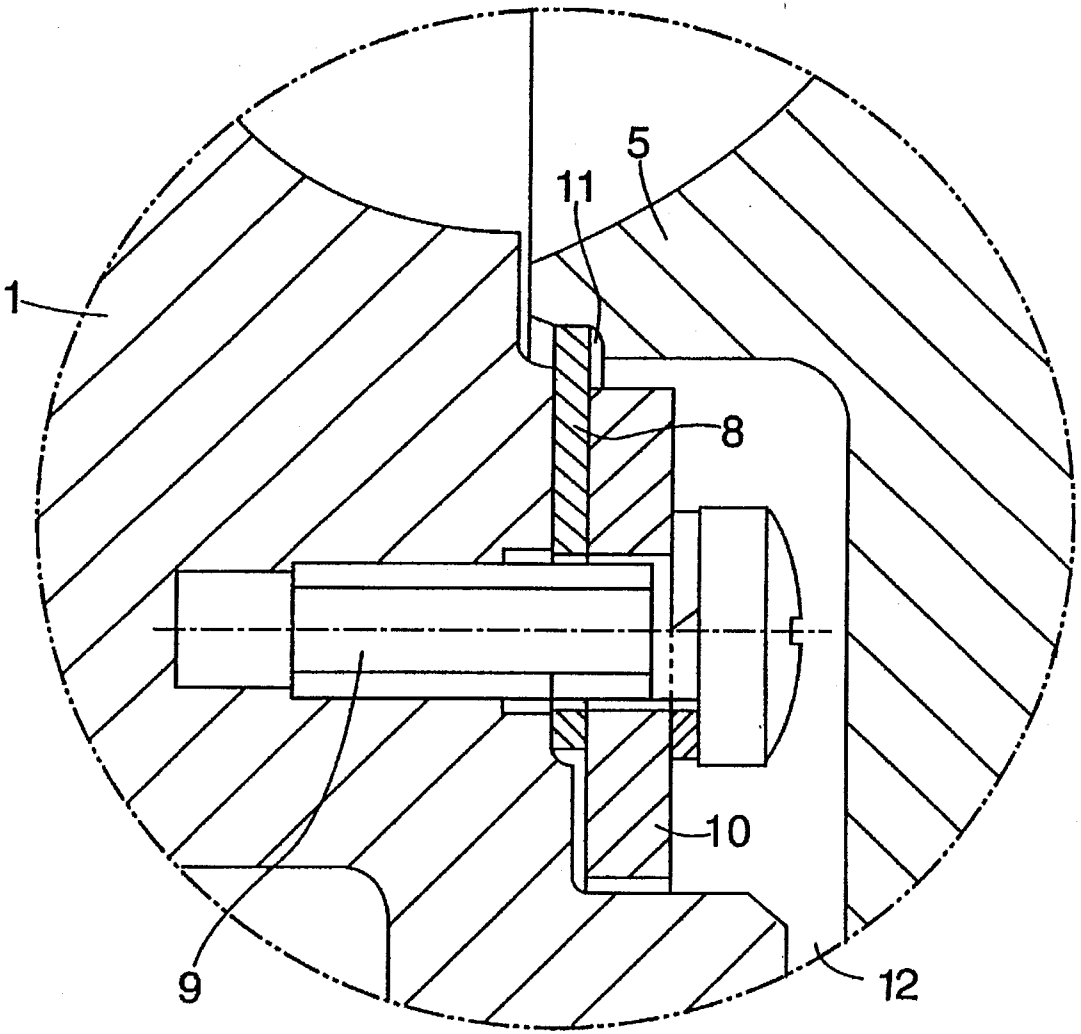
FIG. 2 shows a detail cut-away portion of the sealing arrangement.

On the bearing ring 5, a corner recess 11 is bored on each front side. The sealing ring 8 engages this recess. The sealing ring 8 abuts with its outer surface on the inner circumference of the axially extending wall section of the corner recess 11. The arrangement of the bearing ring with the corner recess and the sealing ring is shown in greater detail in FIG. 2 with the same reference numbers applying to the same elements as in FIG. 1.

As a result of boring the corner recess 11, there is great dimensional accuracy with regard to the diameter of the corner recess 11. Since the sealing ring 8 is also able to be produced with great accuracy with regard to its outside diameter, good sealing effectiveness is attainable. In this manner the leakage loss by way of the gap 12 between the impeller 4 and the respective housing half 1 or 2 is substantially reduced.

What is claimed is:

1. A side channel compressor, comprising:

a. an impeller with delivery blades and a bearing ring;

b. a hub part supporting said impeller, said bearing ring being connected with and axially overhanging said hub part;

c. a housing with said impeller arranged therein to allow rotation of said impeller;

d. a sealing device provided between said impeller and said housing, including, i. a sealing ring contacting an inner surface of said bearing ring that axially overhangs said hub part;

ii. a retaining ring securing said sealing ring against a contact surface provided on said housing.

2. The side channel compressor of claim 1, wherein said retaining ring is fastened to said housing by means of screws.

3. The side channel compressor of claim 1, wherein said bearing ring is provided with a corner recess on a circumferential edge of said bearing ting facing away from said impeller blades and said sealing ring engages said corner recess.

4. The side channel compressor of claim 2, wherein said bearing ring is provided with a corner recess on a circumferential edge of said bearing ring facing away from said impeller blades and said sealing ring engages said corner recess.

* * * * *